US011404045B2

(12) United States Patent
Choi et al.

(10) Patent No.: US 11,404,045 B2
(45) Date of Patent: Aug. 2, 2022

(54) SPEECH SYNTHESIS METHOD AND APPARATUS

(71) Applicant: SAMSUNG ELECTRONICS CO., LTD., Suwon-si (KR)

(72) Inventors: Seungdo Choi, Suwon-si (KR); Kyoungbo Min, Suwon-si (KR); Sangjun Park, Suwon-si (KR); Kihyun Choo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 51 days.

(21) Appl. No.: 17/007,793

(22) Filed: Aug. 31, 2020

(65) Prior Publication Data

US 2021/0065678 A1 Mar. 4, 2021

Related U.S. Application Data

(60) Provisional application No. 62/894,203, filed on Aug. 30, 2019.

(30) Foreign Application Priority Data

Jan. 23, 2020 (KR) ..... 10-2020-0009391

(51) Int. Cl.
*G10L 13/00* (2006.01)
*G10L 13/027* (2013.01)
(Continued)

(52) U.S. Cl.
CPC ..... *G10L 13/08* (2013.01); *G10L 13/047* (2013.01)

(58) Field of Classification Search
CPC ..... G10L 13/07; G10L 13/08; G10L 25/69; G10L 13/027; G10L 13/047
See application file for complete search history.

(56) References Cited

U.S. PATENT DOCUMENTS 6,311,158 B1 10/2001 Laroche
2005/0182629 A1* 8/2005 Coorman ..... G10L 13/07 704/266

(Continued)

FOREIGN PATENT DOCUMENTS

EP 1159738 B1 4/2006
JP 2002-536693 A 10/2002

(Continued)

OTHER PUBLICATIONS

International Search Report and Written Opinion (PCT/ISA/220, PCT/ISA/210, and PCT/ISA/237), dated Nov. 27, 2020 by International Searching Authority in International Application No. PCT/KR2020/011624.

(Continued)

*Primary Examiner* — Shreyans A Patel
(74) *Attorney, Agent, or Firm* — Sughrue Mion, PLLC

(57) ABSTRACT

A speech synthesis method performed by an electronic apparatus to synthesize speech from text and includes: obtaining text input to the electronic apparatus; obtaining a text representation by encoding the text using a text encoder of the electronic apparatus; obtaining an audio representation of a first audio frame set from an audio encoder of the electronic apparatus, based on the text representation; obtaining an audio representation of a second audio frame set based on the text representation and the audio representation of the first audio frame set; obtaining an audio feature of the second audio frame set by decoding the audio representation of the second audio frame set; and synthesizing speech based on an audio feature of the first audio frame set and the audio feature of the second audio frame set.

17 Claims, 11 Drawing Sheets

(51) Int. Cl.
*G10L 13/047* (2013.01)
*G10L 13/08* (2013.01)

(56) References Cited

U.S. PATENT DOCUMENTS

| | | | | |
|---|---|---|---|---|
| 2017/0084292 | A1 | 3/2017 | Yoo | |
| 2019/0122651 | A1* | 4/2019 | Arik | G10L 13/08 |
| 2019/0180732 | A1* | 6/2019 | Ping | G06F 9/30003 |
| 2019/0348020 | A1* | 11/2019 | Clark | G06N 3/0454 |
| 2020/0211528 | A1* | 7/2020 | Lee | G10L 25/69 |

FOREIGN PATENT DOCUMENTS

| | | | |
|---|---|---|---|
| KR | 10-2017-0035625 | A | 3/2017 |
| WO | 2017100407 | A1 | 6/2017 |
| WO | 2018/183650 | A2 | 10/2018 |

OTHER PUBLICATIONS

Tachibana, Hideyuki et al., "Efficiently Trainable Text-to-Speech System Based on Deep Convolutional Networks With Guided Attention", arXiv:1710.08969v1 [cs.SD], Oct. 24, 2017. (5 pages total).

Shen, Jonathan et al., "Natural TTS Synthesis by Conditioning Wavenet on MEL Spectrogram Predictions", arXiv:1712.05884v2 [cs.CL], Feb. 16, 2018. (5 pages total).

* cited by examiner

SPEECH SYNTHESIS METHOD AND APPARATUS

CROSS-REFERENCE TO RELATED APPLICATIONS

This application claims the benefit of U.S. Provisional Application No. 62/894,203, filed on Aug. 30, 2019, in the US Patent Office and priority from Korean Patent Application No. 10-2020-0009391, filed on Jan. 23, 2020, in the Korean Intellectual Property Office, the disclosures of which are herein incorporated by reference in their entireties.

BACKGROUND

1. Field

The disclosure relates to a speech synthesis method and apparatus.

2. Description of Related Art

Recently, various electronic apparatuses have been configured to provide a text-to-speech (TTS) function of synthesizing speech from text and outputting synthesized speech as an audible signal. In order to provide a TTS function, electronic apparatuses may use a certain TTS model including a text phoneme and speech data corresponding to the phoneme.

Recently, artificial neural network (e.g., deep neural network) based speech synthesis methods using end-to-end learning have been actively studied. Speech synthesized according to the speech synthesis methods includes consideration of speech features that are much more natural than those generated via other existing methods. Therefore, there is a demand for designing new artificial neural network structures for reducing the amount of computation required for speech synthesis.

SUMMARY

Provided are a speech synthesis method and apparatus capable of synthesizing speech corresponding to input text by obtaining a current audio frame using feedback information including information about the energy of a previous audio frame.

The objects of the disclosure are not limited to those described above. Other objects and advantages of the disclosure may be understood by the following description and embodiments.

Also, it will be readily appreciated that the objects and advantages of the disclosure may be realized by means of the appended claims and combinations thereof.

Additional aspects will be set forth in part in the description which follows and, in part, will be apparent from the description, or may be learned by practice of the presented embodiments of the disclosure.

According to an embodiment of the disclosure, a method, performed by an electronic apparatus, of synthesizing speech from text, includes: obtaining text input to the electronic apparatus; obtaining a text representation of the text by encoding the text using a text encoder of the electronic apparatus; obtaining a first audio representation of a first audio frame set of the text from an audio encoder of the electronic apparatus, based on the text representation; obtaining a first audio feature of the first audio frame set by decoding the first audio representation of the first audio frame set; obtaining a second audio representation of a second audio frame set of the text based on the text representation and the first audio representation of the first audio frame set; obtaining a second audio feature of the second audio frame set by decoding the second audio representation of the second audio frame set; and synthesizing speech corresponding to the text based on the audio feature of the first audio frame set and the audio feature of the second audio frame set.

According to another embodiment of the disclosure, an electronic apparatus for synthesizing speech from text includes at least one processor configured to: obtain text input to the electronic apparatus; obtain a text representation of the text by encoding the text; obtain a first audio representation of a first audio frame set of the text based on the text representation; obtain a first audio feature of the first audio frame set by decoding the first audio representation of the first audio frame set; obtain a second audio representation of a second audio frame set of the text based on the text representation and the first audio representation of the first audio frame set; obtain a second audio feature of the second audio frame set by decoding the second audio representation of the second audio frame set; and synthesize speech corresponding to the text based on the first audio feature of the first audio frame set and the second audio feature of the second audio frame set.

According to another embodiment of the disclosure, provided is a non-transitory computer-readable recording medium having recorded thereon a program for executing, on an electronic apparatus, a method of synthesizing speech from text, the method including: obtaining text input to the electronic apparatus; obtaining a text representation of the text by encoding the text using a text encoder of the electronic apparatus; obtaining a first audio representation of a first audio frame set of the text from an audio encoder of the electronic apparatus, based on the text representation; obtaining a first audio feature of the first audio frame set by decoding the first audio representation of the first audio frame set; obtaining a second audio representation of a second audio frame set of the text based on the text representation and the first audio representation of the first audio frame set; obtaining a second audio feature of the second audio frame set by decoding the second audio representation of the second audio frame set; and synthesizing speech corresponding to the text based on the audio feature of the first audio frame set and the audio feature of the second audio frame set.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1A:
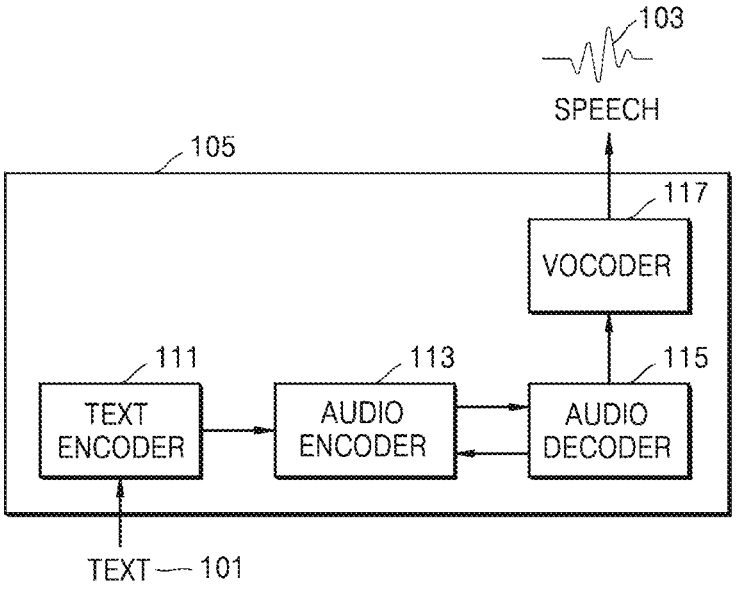
FIG. 1A is a diagram illustrating a an electronic apparatus for synthesizing speech from text, according to an embodiment of the disclosure.

Hereinafter, embodiments of the disclosure will be described in detail with reference to the accompanying drawings so that the disclosure may be easily carried out by those of ordinary skill in the art. However, the disclosure may be embodied in many different forms and is not limited to the embodiments of the disclosure described herein. Also, in order to clearly describe the disclosure, like reference numerals are assigned to like elements throughout the specification.

It will be understood that when a region is referred to as being "connected to" or "coupled to" another region, it may be directly connected or coupled to the other region or intervening regions may be present. It will be understood that the terms "comprise," "include," or "have" as used herein specify the presence of stated elements, but do not preclude the presence or addition of one or more other elements.

Hereinafter, the disclosure will be described in detail with reference to the accompanying drawings.

FIG. 1A is a diagram illustrating an electronic apparatus for synthesizing speech from text, according to an embodiment of the disclosure.

Figure 1B:
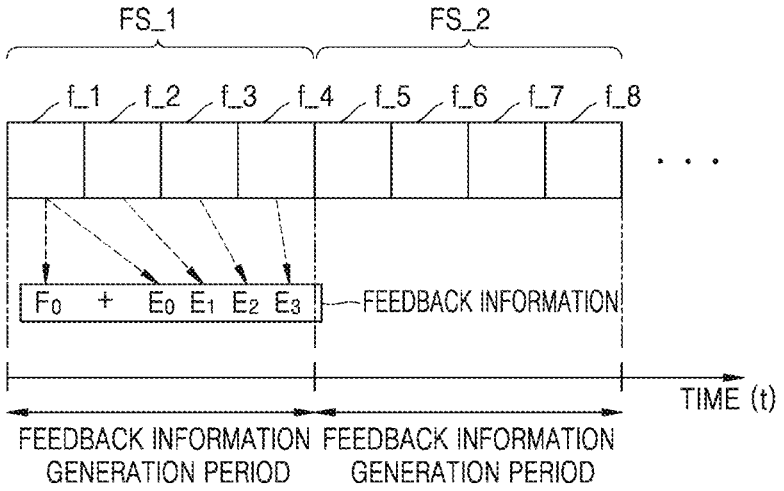
FIG. 1B is a diagram conceptually illustrating a method, performed by an electronic apparatus, of outputting an audio frame from text in the time domain and generating feedback information from the output audio frame, according to an embodiment of the disclosure.

FIG. 1B is a diagram conceptually illustrating a method, performed by an electronic apparatus, of outputting an audio frame from text in a time domain and generating feedback information from the output audio frame, according to an embodiment of the disclosure.

Referring to FIG. 1A, the electronic apparatus according to an embodiment of the disclosure may synthesize speech 103 from text 101 using a speech synthesis model 105. The speech synthesis model 105 may include a text encoder 111, an audio encoder 113, an audio decoder 115, and a vocoder 117.

The text encoder 111 may encode the input text 101 to obtain a text representation.

The text representation is coded information obtained by encoding the input text 101 and may include information about a unique vector sequence corresponding to each character in the text 101.

The text encoder 111, for example, may obtain embeddings for each character included in the text 101 and encode the obtained embeddings to obtain the text representation including information about the unique vector sequence corresponding to each character included in the text 101.

The text encoder 111 may be, for example, a module including at least one of a convolution neural network (CNN), a recurrent neural network (RNN), or a long-short term memory (LSTM), but the text encoder 111 is not limited thereto.

The audio encoder 113 may obtain an audio representation of a first audio frame set.

The audio representation is coded information obtained based on the text representation to synthesize speech from text. The audio representation may be converted into an audio feature by performing decoding using the audio decoder 115.

The audio feature is information including a plurality of components having different spectrum distributions in the frequency domain and may be information used directly for speech synthesis of the vocoder 117. The audio feature may include, for example, information about at least one of spectrum, mel-spectrum, cepstrum, or mfccs, but the audio feature is not limited thereto.

Referring to FIG. 1B, the first audio frame set (FS_1) may include audio frames (f_1, f_2, f_3, and f_4), in which audio features are previously obtained through the audio decoder 115, among the audio frames generated from the text representation, that is, the entire audio frames used for speech synthesis.

The audio encoder 113 may also be, for example, a module including at least one of a CNN, an RNN, or an LSTM, but the audio encoder 113 is not limited thereto.

The audio decoder 115 may obtain audio representation of a second audio frame set FS_2 based on the text representation and the audio representation of the first audio frame set FS_1.

In order to synthesize speech from text using the speech synthesis model, the electronic apparatus according to an embodiment of the disclosure may obtain the audio features of the audio frames f_1 to f_8.

Referring to FIGS. 1A and 1B, the electronic apparatus may obtain the audio features of the audio frames f_1 to f_8 output from the audio decoder 115 in the time domain. In an embodiment of the disclosure, instead of obtaining the audio features of the entire set of audio frames f_1 to f_8, the electronic apparatus may form audio frame subsets FS_1 and FS_2 including a preset number of audio frames among the entire set of audio frames f_1 to f_8 and obtain the audio features of the audio frame subsets FS_1 and FS_2. The preset number may be, for example, four when the set of audio frames f_1 to f_8 is eight audio frames.

In the embodiment of the disclosure illustrated FIG. 1B, the first audio frame subset FS_1 may include the first to fourth audio frames f_1 to f_4, and the second audio frame subset FS_2 may include the fifth to eighth audio frames f_5 to f_8. The second audio frame subset FS_2 may include the audio frames f_5 to f_8 succeeding the first audio frame subset FS_1 in the time domain.

The electronic apparatus may extract feature information about any one of the first to fourth audio frames f_1 to f_4 included in the first audio frame subset FS_1 and extract compression information from at least one audio frame of the first to fourth audio frames f_1 to f_4. In the embodiment of the disclosure illustrated in FIG. 1B, the electronic apparatus may extract audio feature information $F_0$ about the first audio frame f_1 and extract pieces of compression information $E_0$, $E_1$, $E_2$, and $E_3$ from the first to fourth audio frames f_1 to f_4, respectively. The pieces of compression information $E_0$, $E_1$, $E_2$, and $E_3$ may include, for example, at least one of a magnitude of an amplitude value of an audio signal corresponding to the audio frame, a magnitude of a root mean square (RMS) of the amplitude value of the audio signal, or a magnitude of a peak value of the audio signal.

In an embodiment of the disclosure, the electronic apparatus may generate feedback information for obtaining audio feature information about the second audio frame subset FS_2 by combining the audio feature information $F_0$ about the first audio frame f_1 among the audio frames f_1 to f_4 included in the first audio frame subset FS_1 with the pieces of compression information $E_0$, $E_1$, $E_2$, and $E_3$ about the first to fourth audio frames f_1 to f_4. In the embodiment illustrated in FIG. 1B, the configuration in which the electronic apparatus obtains the audio feature information $F_0$ from the first audio frame f_1 of the first audio frame subset FS_1 has been described, but the disclosure is not limited thereto. In another embodiment of the disclosure, the electronic apparatus may obtain audio feature information from any one of the second to fourth audio frames f_2 to f_4 of the first audio frame subset FS_1, instead of the first audio frame f_1.

In an embodiment of the disclosure, a feedback information generation period of the electronic apparatus may correspond to the number of audio frames obtained from the text by the electronic apparatus. In an embodiment of the disclosure, the feedback information generation period may be a length of a speech signal output through a preset number of audio frames. For example, when a speech signal having a length of 10 ms is output through one audio frame, a speech signal corresponding to 40 ms may be output through four audio frames and one piece of feedback information per an output speech signal having a length of 40 ms may be generated. That is, the feedback information generation period may be the length of the output speech signal corresponding to the four audio frames. However, the configuration is not limited thereto.

In an embodiment of the disclosure, the feedback information generation period may be determined based on characteristics of a person who utters speech. For example, when a period for obtaining audio features of four audio frames with respect to a user having an average speech rate is determined as the feedback information generation period, the electronic apparatus may determine, as the feedback information generation period, a period for obtaining audio features of six audio frames with respect to a user having a relatively slow speech rate. In contrast, the electronic apparatus may determine, as the feedback information generation period, a period for obtaining audio features of two audio frames with respect to a user having a relatively fast speech rate. In this case, the determination regarding the speech rate may be made based on, for example, measured phonemes per unit of time. The speech rate for each user may be stored in a database, and the electronic apparatus may determine the feedback information generation period according to the speech rate with reference to the database and may perform learning using the determined feedback information generation period.

The electronic apparatus may change the feedback information generation period based on a type of text. In an embodiment of the disclosure, the electronic apparatus may identify the type of text using a pre-processor (310 in FIG. 3). The pre-processor 310 may include, for example, a module such as a grapheme-to-phoneme (G2P) module or a morpheme analyzer and may output a phoneme sequence or a grapheme sequence by performing pre-processing using at least one of the G2P module or the morpheme analyzer. For example, when the text is "hello," the electronic apparatus may separate the text into consonants and vowels, like "hello," through the pre-processor 310 and check the order and frequency of the consonants and the vowels. When the text is a vowel or silence, the electronic apparatus may slowly change the feedback information generation period. For example, when the feedback information generation period is a length of a speech signal output through four audio frames and the text is vowel or silence, the electronic apparatus may change the feedback information generation period to a length of an output speech signal corresponding to six audio frames. As another example, when the type of text is a consonant or unvoiced sound, the electronic apparatus may change the feedback information generation period to be short. For example, when the text is a consonant or unvoiced sound, the electronic apparatus may change the feedback information generation period to a length of an output speech signal corresponding to two audio frames.

In another example, the electronic apparatus may output phonemes from text through the pre-processor 310, may convert the phonemes of the text into phonetic symbols using a prestored pronunciation dictionary, may estimate pronunciation information about the text according to the phonetic symbols, and may change the feedback information generation period based on the estimated pronunciation information.

Generally, in the case of consonants or unvoiced sounds, because the length of the speech signal is short, the number of audio frames corresponding to the speech signal is small. In the case of vowels or silence, because the length of the speech signal is long, the number of audio frames corresponding to the speech signal is large. The electronic apparatus according to the embodiment of the disclosure flexibly changes the feedback information generation period according to the type of text, such as consonants, vowels, silences, and unvoiced sounds, such that the accuracy of obtaining attention information is improved and speech synthesis performance is improved. Also, when a relatively small number of audio frames are required for outputting a speech signal, such as consonants or unvoiced sounds, an amount of computation may be reduced according to the obtaining of audio feature information and the obtaining of feedback information from the audio frames.

Referring to FIG. 1A, the audio decoder 115 may obtain an audio representation of second audio frames based on previously obtained audio representation of first audio frames.

As described above, the electronic apparatus according to an embodiment of the disclosure may obtain audio features for synthesizing speech in units of multiple audio frames, such that the amount of computation required for obtaining audio features is reduced.

The audio decoder 115 may obtain audio features of the second audio frames by decoding the audio representation of the second audio frames.

The audio decoder 115 may be, for example, a module including at least one of a CNN, an RNN, or an LSTM, but the audio decoder 115 is not limited thereto.

The vocoder 117 may synthesize the speech 103 based on the audio features obtained by the audio decoder 115.

The vocoder 117 may synthesize the speech 103 corresponding to the text 101 based on, for example, at least one of the audio features of the first audio frames or the audio features of the second audio frames, which are obtained by the audio decoder 115.

The vocoder 117 may synthesize the speech 103 from the audio feature based on, for example, at least one of WaveNet, Parallel WaveNet, WaveRNN, or LPCNet. However, the vocoder 117 is not limited thereto.

For example, when the audio feature of the second audio frame subset FS_2 is obtained, the audio encoder 113 may receive the audio feature of the second audio frame subset FS_2 from the audio decoder 115 and may obtain audio representation of a third audio frame set succeeding the second audio frame subset FS_2 based on the audio feature of the second audio frame subset FS_2 and the text representation received from the text encoder 111.

Audio features from the audio feature of the first audio frame to the audio feature of the last audio frame among audio frames constituting the speech to be synthesized may be sequentially obtained through the feedback loop method of a speech learning model.

In order to synthesize speech having a natural rhythm, the electronic apparatus according to an embodiment of the disclosure may convert the previously obtained audio feature of the first audio frame subset FS_1 into certain feedback information in the process of obtaining the audio representation of the second audio frame subset FS_2, instead of using the previously obtained audio feature of the first audio frame subset FS_1 as originally generated.

That is, the speech synthesis model may convert the text representation into the audio representation through the text encoder 111 and the audio decoder 115 to obtain the audio feature for synthesizing the speech corresponding to the text, and may convert the obtained audio feature to synthesize the speech.

Hereinafter, a speech synthesis method according to an embodiment of the disclosure will be described in detail based on an embodiment of the disclosure in which the speech synthesis model used by the electronic apparatus obtains and uses the feedback information.

Figure 2:
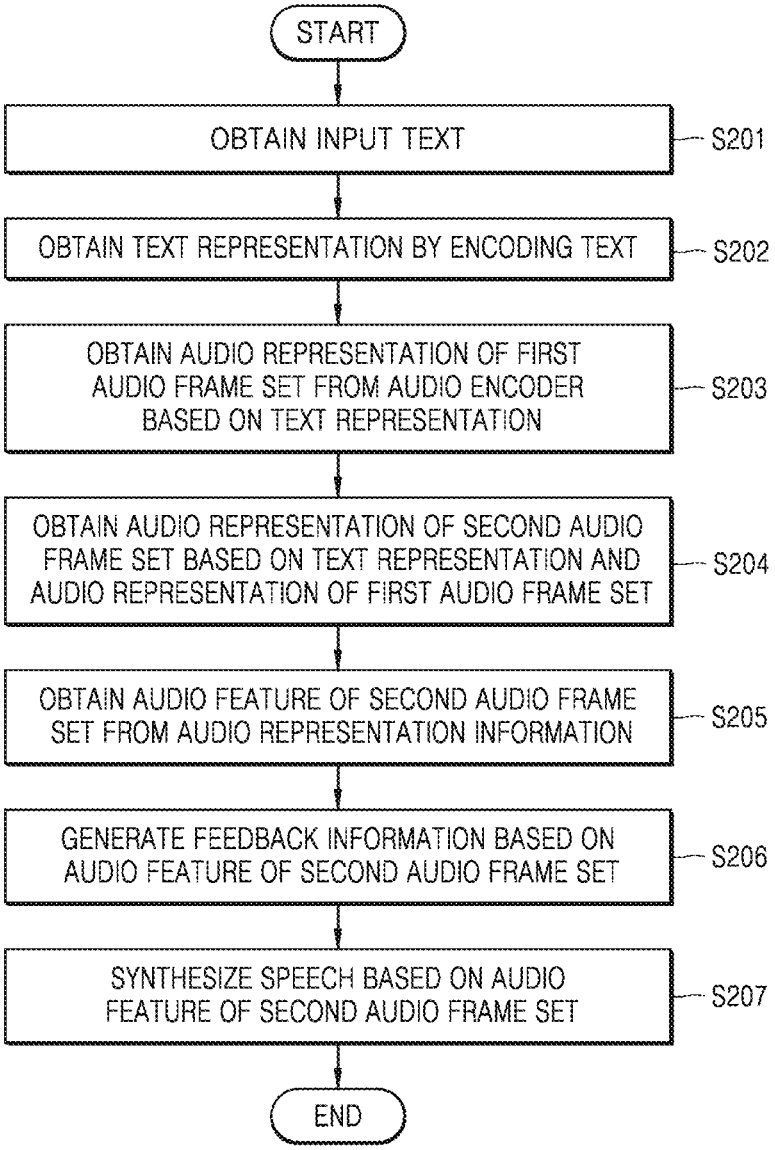
FIG. 2 is a flowchart of a method, performed by an electronic apparatus, of synthesizing speech from text using a speech synthesis model, according to an embodiment of the disclosure.

FIG. 2 is a flowchart of a method, performed by an electronic apparatus, of synthesizing speech from text using a speech synthesis model, according to an embodiment of the disclosure.

A specific method, performed by an electronic apparatus, of synthesizing speech from text using a speech synthesis model and a specific method, performed by an electronic apparatus, of learning a speech synthesis model will be described below with reference to embodiments of the disclosure illustrated in FIGS. 3 and 4.

Referring to FIG. 2, in operation S201, the electronic apparatus according to an embodiment of the disclosure may obtain input text.

In operation S202, the electronic apparatus may obtain text representation by encoding the input text. In an embodiment of the disclosure, the electronic apparatus may encode embeddings for each character included in the input text using the text encoder (111 in FIG. 1A) to obtain text representation including information about a unique vector sequence corresponding to each character included in the input text.

In operation S203, the electronic apparatus may obtain audio representation of a first audio frame set based on the text representation. Obtaining the audio representation of the audio frames has been described above with respect to FIG. 1B. Hereinafter, the terms set and subset may be used interchangeably for convenience of expression to refer to processed audio frames.

In operation S204, the electronic apparatus may obtain audio representation of a second audio frame set based on the text representation and the audio representation of the first audio frame set.

In operation S205, the electronic apparatus may obtain an audio feature of the second audio frame set from audio representation information about the second audio frame set. In an embodiment of the disclosure, the electronic apparatus may obtain the audio feature of the second audio frame set by decoding the audio representation of the second audio frame set using the audio decoder (115 in FIG. 1A). The audio feature is information including a plurality of components having different spectrum distributions in the frequency domain. The audio feature may include, for example, information about at least one of spectrum, mel-spectrum, cepstrum, or mfccs, but the audio feature is not limited thereto.

In operation S206, the electronic apparatus may generate feedback information based on the audio feature of the second audio frame set. The feedback information may be information obtained from the audio feature of the second audio frame set for use in obtaining an audio feature of a third audio frame set succeeding the second audio frame set.

The feedback information may include, for example, compression information about at least one audio frame included in the second audio frame set, as well as information about the audio feature of at least one audio frame included in the second audio frame set.

The compression information about the audio frame may include information about energy of the corresponding audio frame.

The compression information about the audio frame may include, for example, information about the total energy of the audio frame and the energy of the audio frame for each frequency. The energy of the audio frame may be a value associated with the intensity of sound corresponding to the audio feature of the audio frame.

In an embodiment of the disclosure, when the audio feature of a specific audio frame is an 80 frames mel-spectrum, the corresponding audio frame M may be expressed by the following Equation 1.

$$M=[a_1,a_2,a_3, \ldots, a_{80}] \quad \text{[Equation 1]}$$

At this time, the energy of the audio frame M may be obtained based on, for example, the following "mean of mel-spectrum" Equation 2.

$$(\text{energy}) = \frac{1}{80} * \sum_{i=0}^{80} a_i \quad \text{[Equation 2]}$$

As another example, the energy of the audio frame M may be obtained based on the following "RMS of mel-spectrum" Equation 3.

$$(\text{energy}) = \sqrt{\frac{1}{80}\sum_{i=0}^{80} a_i^2} \quad \text{[Equation 3]}$$

In another embodiment of the disclosure, when the audio feature of a specific audio frame is a 22 frames cepstrum, the corresponding audio frame C may be expressed by the following Equation 4.

$$C=[b_1,b_2,b_3, \ldots, b_{22}] \quad \text{[Equation 4]}$$

At this time, because the correlation between the first element and the actual sound intensity is relatively high in the cepstrum, the energy of the audio frame C may be, for example, the first element $b^1$ of the cepstrum.

The compression information about the audio frame may include, for example, at least one of a magnitude of an amplitude value of an audio signal corresponding to the audio frame, a magnitude of an RMS of the amplitude value of the audio signal, or a magnitude of a peak value of the audio signal.

The electronic apparatus may generate feedback information, for example, by combining information about the audio feature of at least one audio frame included in the second audio frame set with compression information about the at least one audio frame included in the second audio frame set.

Operations S203 to S206 may be repeatedly performed on consecutive n audio frame sets. In an embodiment of the disclosure, the electronic apparatus may obtain audio representation of a $k^{th}$ audio frame set in operation S203, obtain audio representation of a $(k+1)^{th}$ audio frame set based on the text representation and the audio representation of the $k^{th}$ audio frame set in operation S204, obtain audio feature information about the $(k+1)^{th}$ audio frame set by decoding the audio representation of the $(k+1)^{th}$ audio frame set in operation S205, and generate feedback information based on the audio feature of the $(k+1)^{th}$ audio frame set in operation S206 (k is an ordinal number for the consecutive audio frame sets, and a value of k is 1, 2, 3, . . . , n). When a value of k+1 is less than or equal to the total number n of audio frame sets, the electronic apparatus may obtain audio representation of a $(k+2)^{th}$ audio frame set succeeding the $(k+1)^{th}$ audio frame set by encoding the feedback information about the $(k+1)^{th}$ audio frame set using the audio encoder (314 in FIG. 3). That is, when a value of k+1 is less than or equal to the total number n of audio frame sets, the electronic apparatus may repeatedly perform operations S203 to S206.

A specific method, performed by the electronic apparatus, of generating feedback information will be described below with reference to FIGS. 5 and 6.

In operation S207, the electronic apparatus may synthesize speech based on at least one of the audio feature of the first audio frame set or the audio feature of the second audio frame set. In operation S207, when the audio feature of the $k^{th}$ audio frame set or the audio feature of the $(k+1)^{th}$ audio frame set is obtained, speech may be synthesized, but the method is not limited thereto. In an embodiment of the disclosure, after the electronic apparatus repeatedly performs operations S203 to S206 until the audio feature of the $n^{th}$ audio frame set is obtained, the electronic apparatus may synthesize speech based on at least one of the audio features of the $(k+1)^{th}$ to $n^{th}$ audio frame sets.

FIG. 2 illustrates that operation S207 is performed sequentially after operation S206, but the method is not limited thereto.

Figure 3:
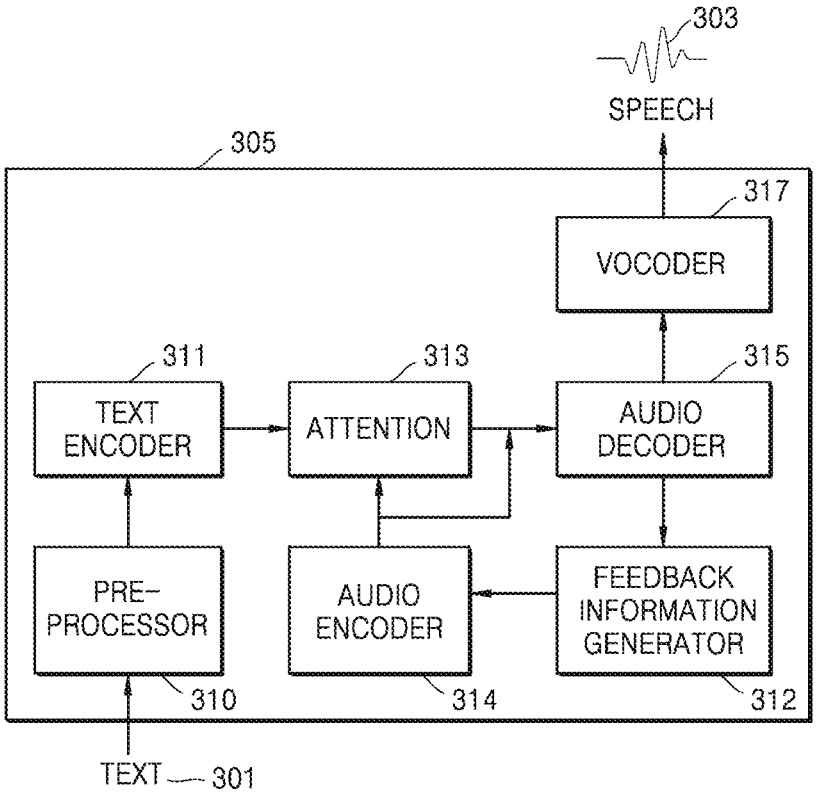
FIG. 3 is a diagram illustrating an electronic apparatus for synthesizing speech from text using a speech learning model, according to an embodiment of the disclosure.

FIG. 3 is a diagram illustrating an electronic apparatus for synthesizing speech from text using a speech learning model, according to an embodiment of the disclosure.

Referring to FIG. 3, the electronic apparatus according to an embodiment of the disclosure may synthesize speech 303 from text 301 using a speech synthesis model 305. The speech synthesis model 305 may include a pre-processor 310, a text encoder 311, a feedback information generator 312, an attention module 313, an audio encoder 314, an audio decoder 315, and a vocoder 317.

The pre-processor 310 may perform pre-processing on the text 301 such that the text encoder 311 obtains information about at least one of vocalization or meaning of the text to learn patterns included in the input text 301.

The text in the form of natural language may include a character string that impairs the essential meaning of the text, such as misspelling, omitted words, and special characters. The pre-processor 310 may perform pre-processing on the text 301 to obtain information about at least one of vocalization or meaning of the text from the text 301 and to learn patterns included in the text.

The pre-processor 310 may include, for example, a module such as a G2P module or a morpheme analyzer. Such a module may perform pre-processing based on a preset rule or a pre-trained model. The output of the pre-processor 310 may be, for example, a phoneme sequence or a grapheme sequence, but the output of the pre-processor 310 is not limited thereto.

The text encoder 311 may obtain a text representation by encoding the pre-processed text received from the pre-processor 310.

The audio encoder 314 may receive previously generated feedback information from the feedback information generator 312 and obtain an audio representation of a first audio frame set by encoding the received feedback information.

The attention module 313 may obtain attention information for identifying a portion of the text representation requiring attention, based on at least part of the text representation received from the text encoder 311 and the audio representation of the first audio frame set received from the audio encoder 314.

Because it may be common to use the text representation including information about a fixed-sized vector sequence as an input sequence of the speech synthesis model, an attention mechanism may be used to learn a mapping relationship between the input sequence and the output sequence of the speech synthesis model.

The speech synthesis model using the attention mechanism may refer to the entire text input to the text encoder, that is, the text representation, again at every time-step for obtaining audio features required for speech synthesis. Here, the speech synthesis model may increase the efficiency and accuracy of speech synthesis by intensively referring to portions associated with the audio features to be predicted at each time-step, without referring to all portions of the text representation at the same proportion.

The attention module 313, for example, may identify a portion of the text representation requiring attention, based on at least part of the text representation received from the text encoder 311 and the audio representation of the first audio frame set received from the audio encoder 314. The attention module 313 may generate attention information including information about the portion of the text representation requiring attention.

A specific method, performed by the electronic apparatus, of obtaining the audio representation of the second audio frame set based on the text representation and the attention information will be described below with reference to embodiments of the disclosure illustrated in FIGS. 7 and 8.

The audio decoder 315 may generate audio representation of a second audio frame set succeeding the first audio frame set, based on the attention information received from the attention module 313 and the audio representation of the first audio frame set received from the audio encoder 314.

The audio decoder 315 may obtain the audio feature of the second audio frame set by decoding the generated audio representation of the second audio frame set.

The vocoder 317 may synthesize the speech 303 corresponding to the text 301 by converting at least one of the audio feature of the first audio frame set or the audio feature of the second audio frame set, which is received from the audio decoder 315.

When the audio decoder 315 obtains the audio feature of the second audio frame set, the feedback information generator 312 may receive the audio feature of the second audio frame set from the audio decoder 315.

The feedback information generator 312 may obtain feedback information used to obtain an audio feature of a third audio frame set succeeding the second audio frame set, based on the audio feature of the second audio frame set received from the audio decoder 315.

That is, the feedback information generator 312 may obtain the feedback information for obtaining the audio feature of the audio frame set succeeding the previously obtained audio frame set, based on the previously obtained audio feature of the audio frame set received from the audio decoder 315.

Audio features from the audio feature of the first audio frame set to the audio feature of the last audio frame set among audio frames constituting the speech to be synthesized may be sequentially obtained through the feedback loop method of the speech learning model.

Figure 4:
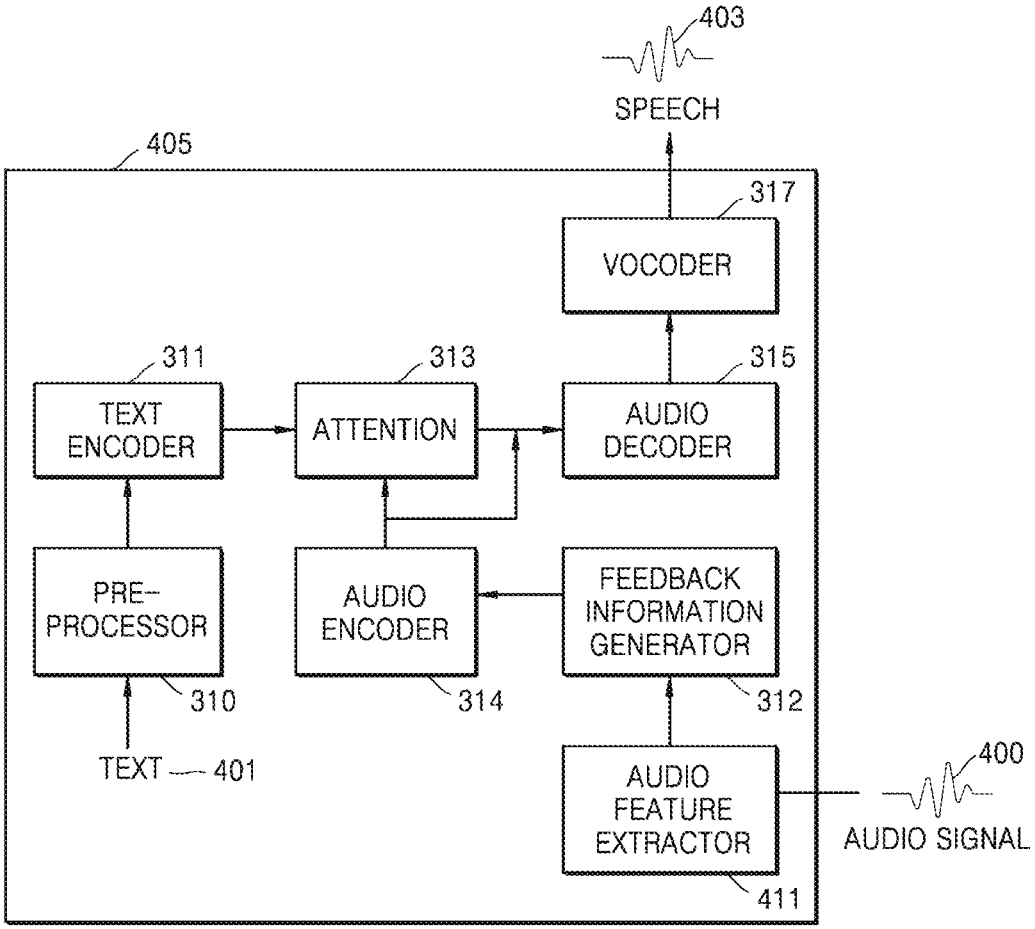
FIG. 4 is a diagram illustrating an electronic apparatus for learning a speech synthesis model, according to an embodiment of the disclosure.

FIG. 4 is a diagram illustrating an electronic apparatus for learning a speech synthesis model, according to an embodiment of the disclosure.

The speech synthesis model used by the electronic apparatus according to an embodiment of the disclosure may be trained through a process of receiving, as training data, audio features obtained from a text corpus and an audio signal corresponding to the text corpus and synthesizing speech corresponding to the input text.

Referring to FIG. 4, the speech synthesis model 405 trained by the electronic apparatus according to an embodiment of the disclosure may further include an audio feature extractor 411 that obtains an audio feature from a target audio signal, as well as a pre-processor 310, a text encoder 311, a feedback information generator 312, an attention module 313, an audio encoder 314, an audio decoder 315, and a vocoder 317, which have been described above with reference to FIG. 3.

The audio feature extractor 411 may extract audio features of the entire audio frames constituting an input audio signal 400.

The feedback information generator 312 may obtain feedback information required for obtaining the audio features of the entire audio frames constituting the speech 403 from the audio features of the entire audio frames of the audio signal 400 received from the audio feature extractor 411.

The audio encoder 314 may obtain audio representation of the entire audio frames of the audio signal 400 by encoding the feedback information received from the feedback information generator 312.

The pre-processor 310 may pre-process the input text 401.

The text encoder 311 may obtain text representation by encoding the pre-processed text received from the pre-processor 310.

The attention module 313 may obtain attention information for identifying a portion of the text representation requiring attention, based on the text representation received from the text encoder 311 and the audio representation of the entire audio frames of the audio signal 400 received from the audio encoder 314.

The audio decoder 315 may obtain the audio representation of the entire audio frames constituting the speech 403, based on the attention information received from the attention module 313 and the audio representation of the entire audio frames of the audio signal 400 received from the audio encoder 314.

The audio decoder 315 may obtain the audio features of the entire audio frames constituting the speech 403 by decoding the audio representation of the entire audio frames constituting the speech 403.

The vocoder 317 may synthesize the speech 403 corresponding to the text 401 based on the audio features of the entire audio frames constituting the speech 403, which are received from the audio decoder 315.

The electronic apparatus may learn the speech synthesis model by comparing the audio features of the audio frames constituting the synthesized speech 403 with the audio features of the entire audio frames of the audio signal 400 and obtaining a weight parameter that minimizes a loss between both the audio features.

Figure 5:
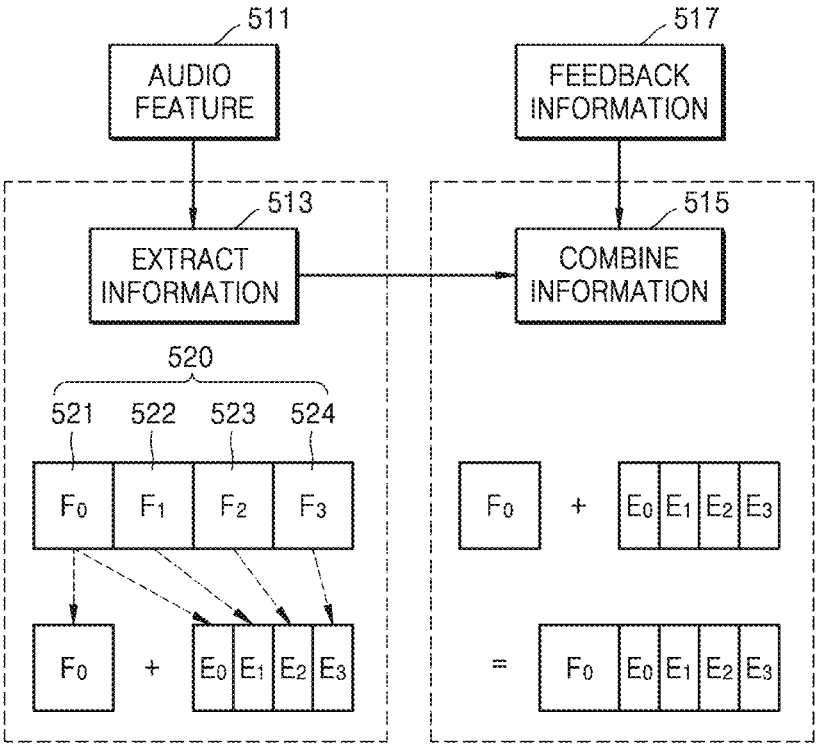
FIG. 5 is a diagram illustrating an electronic apparatus for generating feedback information, according to an embodiment of the disclosure.

FIG. 5 is a diagram illustrating an electronic apparatus for generating feedback information, according to an embodiment of the disclosure.

The speech synthesis model used by the electronic apparatus according to an embodiment of the disclosure may include a feedback information generator that obtains feedback information from audio features.

The feedback information generator may generate feedback information used to obtain the audio feature of the second audio frame set succeeding the first audio frame set, based on the audio feature of the first audio frame set obtained from the audio decoder.

The feedback information generator, for example, may obtain information about the audio feature of at least one audio frame of the first audio frame set and simultaneously obtain compression information about at least one audio frame of the first audio frame set.

The feedback information generator, for example, may generate feedback information by combining the obtained information about the audio feature of at least one audio frame with the obtained compression information about at least one audio frame.

Referring to FIG. 5, the feedback information generator of the speech synthesis model according to an embodiment of the disclosure may extract information required for generating the feedback information from the audio feature 511 (513).

The feedback information generator, for example, may extract the information required for generating the feedback information from pieces of information $F_0$, $F_1$, $F_2$, and $F_3$ about audio features of first to fourth audio frames 521, 522, 523, and 524 included in a first audio frame set 520.

The feedback information generator, for example, may obtain pieces of compression information $E_0$, $E_1$, $E_2$, and $E_3$ about the audio frames from the pieces of information $F_0$, $F_1$, $F_2$, and $F_3$ about the audio features of the first to fourth audio frames 521, 522, 523, and 524 included in the first audio frame set 520.

The compression information may include, for example, at least one of magnitudes of amplitude values of audio signals corresponding to the first to fourth audio frames 521, 522, 523, and 524, a magnitude of average RMS of the amplitude values of the audio signals, or magnitudes of peak values of the audio signals.

The feedback information generator may generate feedback information 517 by combining at least one of pieces of information $F_0$, $F_1$, $F_2$, and $F_3$ about the audio features of the first to fourth audio frames 521, 522, 523, and 524 with the extracted information 513 (515).

The feedback information generator, for example, may generate feedback information by combining the information $F_0$ about the audio feature of the first audio frame 521 with pieces of compression information $E_0$, $E_1$, $E_2$, and $E_3$ about the first audio frame 521, the second audio frame 522, the third audio frame 523, and the fourth audio frame 524. However, in another embodiment of the disclosure, the feedback information generator may obtain the information $F_0$ from any one of the second audio frame 522, the third audio frame 523, and the fourth audio frame 524.

Figure 6:
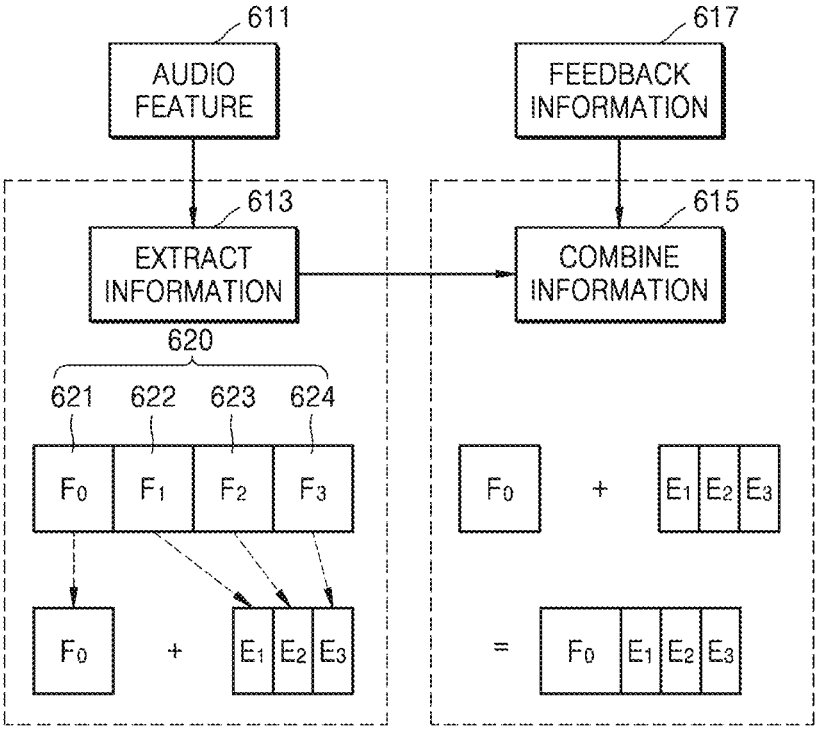
FIG. 6 is a diagram illustrating a method, performed by an electronic apparatus, of generating feedback information, according to an embodiment of the disclosure.

FIG. 6 is a diagram illustrating a method, performed by the electronic apparatus, of generating feedback information, according to an embodiment of the disclosure.

Referring to FIG. 6, the feedback information generator of the speech synthesis model used by the electronic apparatus according to an embodiment of the disclosure may extract information required for generating feedback information from an audio feature 611 (613).

The feedback information generator, for example, may extract the information required for generating the feedback information from pieces of information $F_0$, $F_1$, $F_2$, and $F_3$ about audio features of first to fourth audio frames 621, 622, 623, and 624 included in a first audio frame set 620.

The feedback information generator, for example, may obtain pieces of compression information $E_1$, $E_2$, and $E_3$ about the audio frames from the pieces of information $F_1$, $F_2$, and $F_3$ about the audio features of the second to fourth audio frames 622 to 624.

The compression information may include, for example, at least one of magnitudes of amplitude values of audio signals corresponding to the second to fourth audio frames 622 to 624, a magnitude of average RMS of the amplitude values of the audio signals, or magnitudes of peak values of the audio signals.

The feedback information generator may generate feedback information 617 by combining at least one of pieces of information $F_0$, $F_1$, $F_2$, and $F_3$ about the audio features of the first audio frame set 620 with the extracted information 613 (515).

The feedback information generator, for example, may generate feedback information by combining the information $F_0$ about the audio feature of the first audio frame 621 with pieces of compression information $E_1$, $E_2$, and $E_3$ about the second to fourth audio frames 622 to 624. However, the disclosure is not limited thereto. In another embodiment of the disclosure, the feedback information generator may obtain the information $F_0$ from any one of the second audio frame 622, the third audio frame 623, and the fourth audio frame 624.

When comparing the feedback information obtained in the embodiment of the disclosure illustrated in FIG. 6 with the feedback information obtained in the embodiment of the disclosure illustrated in FIG. 5, it may be seen that the feedback information obtained in the embodiment of the disclosure illustrated in FIG. 6 does not include compression information $E_0$ about the first audio frame 521.

That is, the speech synthesis model used by the electronic apparatus according to the disclosure may generate feedback information by extracting compression information from pieces of information about the audio features of the first audio frame sets 520 and 620 in a free manner and combining the pieces of extracted compression information.

Figure 7:
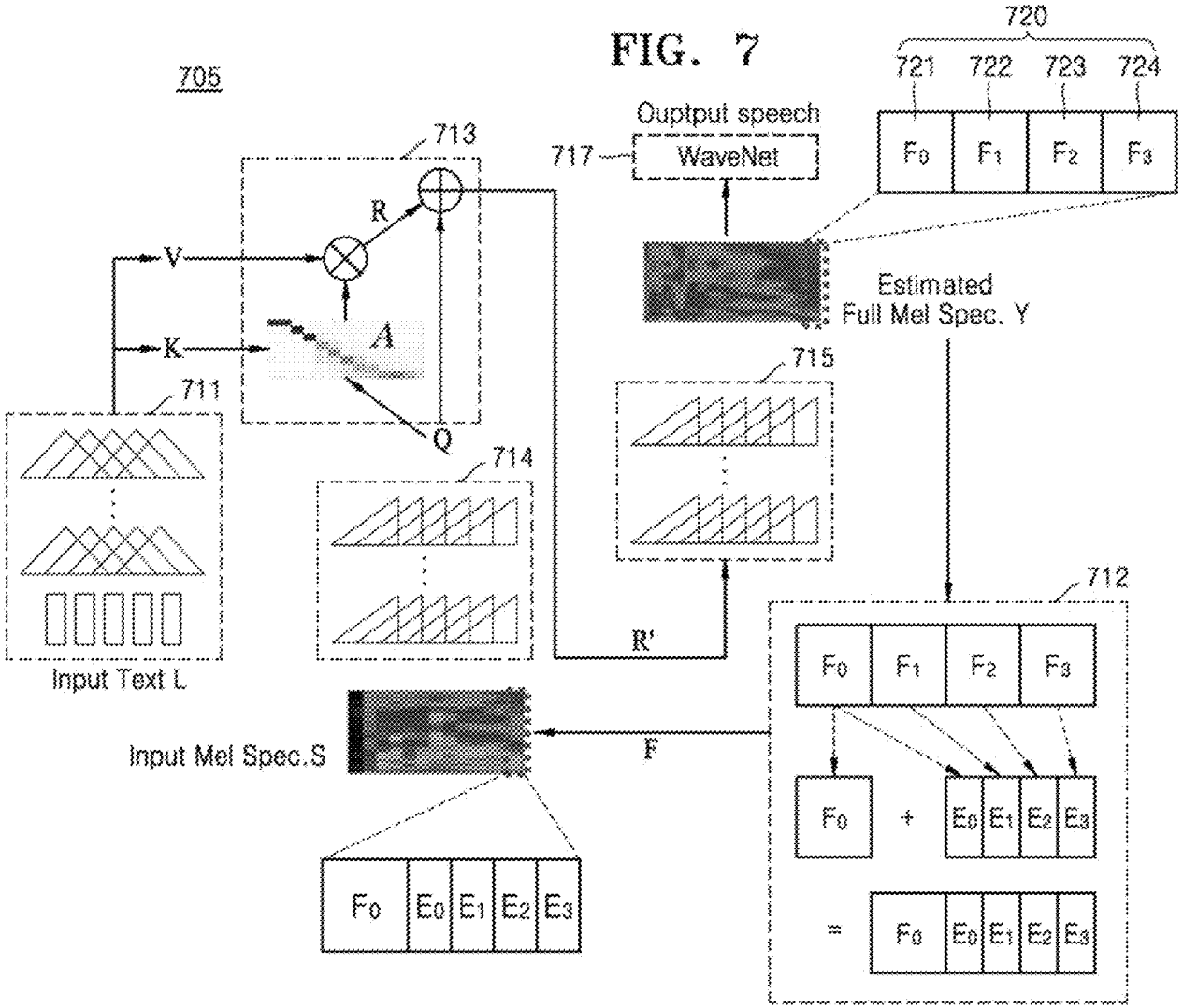
FIG. 7 is a diagram illustrating a method, performed by an electronic apparatus, of synthesizing speech using a speech synthesis model including a convolution neural network, according to an embodiment of the disclosure.

FIG. 7 is a diagram illustrating a method, performed by an electronic apparatus, of synthesizing speech using a speech synthesis model including a CNN, according to an embodiment of the disclosure.

Referring to FIG. 7, the electronic apparatus according to an embodiment of the disclosure may synthesize speech from text using a speech synthesis model. The speech synthesis model 705 may include a text encoder 711, a feedback information generator 712, an attention module 713, an audio encoder 714, an audio decoder 715, and a vocoder 717.

The text encoder 711 may obtain text representation K and text representation V by encoding input text L.

The text representation K may be text representation that is used to generate attention information A used to determine which portion of the text representation is associated with audio representation Q to be described below.

The text representation V may be text representation that is used to obtain audio representation R by identifying a portion of the text representation V requiring attention, based on the attention information A.

The text encoder 711 may include, for example, an embedding module and a one-dimensional (1D) non-causal convolution layer for obtaining embeddings for each character included in the text L.

Because the text encoder 711 may obtain information about context of both a preceding character and a succeeding character with respect to a certain character included in the text, the 1D non-causal convolution layer may be used.

When the embeddings for each character included in the text L are obtained through the embedding module of the text encoder 711 and the obtained embeddings are input to the 1D non-causal convolution layer, the text representation K and the text representation V may be output as a result of the same convolution operation on the embeddings.

The feedback information generator 712, for example, may generate feedback information F used to obtain the audio feature of the second audio frame set including four audio frames succeeding four audio frames 721, 722, 723, and 724 from the audio features of four first audio frame sets 720 previously obtained through the audio decoder 715.

For example, when the feedback information F1 to be generated corresponds to the first feedback information for the start of the feedback loop, the feedback information generator 712 may generate the feedback information F1 used to obtain the audio features of four second audio frame sets succeeding the four audio frames 721, 722, 723, and 724 from the audio features of the four audio frames 721, 722, 723, and 724 each having a value of zero.

As described above with reference to the embodiment of the disclosure illustrated in FIG. 5, the feedback information F1 according to an embodiment of the disclosure may be generated by combining the information $F_0$ about the audio feature of the first audio frame 721 with the pieces of compression information $E_0$, $E_1$, $E_2$, and $E_3$ for the first to fourth audio frames 721 to 724.

The audio encoder 714 may obtain the audio representation Q1 of the four audio frames 721, 722, 723, and 724 based on the feedback information F1 received from the feedback information generator 712.

The audio encoder 714 may include, for example, a 1D causal convolution layer. Because the output of the audio decoder 715 may be provided as feedback to the input of the audio encoder 714 in the speech synthesis process, the audio decoder 715 may use the 1D causal convolution layer so as not to use information about a succeeding audio frame, that is, future information.

That is, the audio encoder 714, for example, may obtain audio representation Q1 of the four audio frames 721, 722, 723, and 724 as a result of a convolution operation based on feedback information (for example, $F_0$) generated with respect to the audio frame set temporally preceding the four audio frames 721, 722, 723, and 724 and the feedback information F1 received from the feedback information generator 712.

The attention module 713 may obtain attention information A1 for identifying a portion of the text representation V requiring analysis, based on the text representation K received from the text encoder 711 and the audio representation Q1 of the first audio frame set 720 received from the audio encoder 714.

The attention module 713, for example, may obtain attention information A1 by calculating a matrix product between the text representation K received from the text encoder 711 and the audio representation Q1 of the first audio frame set 720 received from the audio encoder 714.

The attention module 713, for example, may refer to the attention information A0 generated with respect to the audio frame set temporally preceding the four audio frames 721, 722, 723, and 724 in the process of obtaining the attention information A1.

The attention module 713 may obtain the audio representation R1 by identifying a portion of the text representation V requiring attention, based on the obtained attention information A1.

The attention module 713, for example, may obtain a weight from the attention information A1 and obtain the audio representation R1 by calculating a weighted sum between the attention information A1 and the text representation V based on the obtained weight.

The attention module 713 may obtain audio representation R1' by concatenating the audio representation R1 and the audio representation Q1 of the first audio frame set 720.

The audio decoder 715 may obtain the audio feature of the second audio frame set by decoding the audio representation R1' received from the attention module 713.

The audio decoder 715 may include, for example, a 1D causal convolution layer. Because the output of the audio decoder 715 may be fed back to the input of the audio encoder 714 in the speech synthesis process, the audio decoder 715 may use the 1D causal convolution layer so as not to use information about a succeeding audio frame, that is, future information.

That is, the audio encoder 715, for example, may obtain the audio feature of the second audio frame set succeeding the four audio frames 721, 722, 723, and 724 as a result of a convolution operation based on the audio representation R1, the audio representation Q1, and the audio representation (e.g., the audio representation R0 and the audio representation Q0) generated with respect to the audio frame set temporally preceding the four audio frames 721, 722, 723, and 724.

The vocoder 717 may synthesize speech based on at least one of the audio feature of the first audio frame set 720 or the audio feature of the second audio frame set.

When the audio feature of the second audio frame set is obtained, the audio decoder 715 may transmit the obtained audio feature of the second audio frame set to the feedback information generator 712.

The feedback information generator 712 may generate feedback information F2 used to obtain an audio feature of a third audio frame set succeeding the second audio frame set, based on the audio feature of the second audio frame set. The feedback information generator 712, for example, may generate feedback information F2 used to obtain the audio feature of the third audio frame succeeding the second audio frame set, based on the same method as the above-described method of generating the feedback information F1.

The feedback information generator 712 may transmit the generated feedback information F2 to the audio encoder 714.

The audio encoder 714 may obtain the audio representation Q2 of the four second audio frames based on the feedback information F2 received from the feedback information generator 712.

The audio encoder 714, for example, may obtain audio representation Q2 of the four second audio frames as a result of a convolution operation based on the feedback information (e.g., at least one of $F_0$ or $F_1$) generated with respect to the audio frame set temporally preceding the four audio frames and the feedback information F2 received from the feedback information generator 712.

The attention module 713 may obtain attention information A2 for identifying a portion of the text representation V requiring attention, based on the text representation K received from the text encoder 711 and the audio representation Q2 of the second audio frame set received from the audio encoder 714.

The attention module 713, for example, may obtain attention information A1 by calculating a matrix product between the text representation K received from the text encoder 711 and the audio representation Q2 of the second audio frame set received from the audio encoder 714.

The attention module 713, for example, may refer to the attention information (e.g., the attention information A1) generated with respect to the audio frame set temporally preceding the four second audio frames in the process of obtaining the attention information A2.

The attention module 713 may obtain the audio representation R2 by identifying a portion of the text representation V requiring attention, based on the obtained attention information A2.

The attention module 713, for example, may obtain a weight from the attention information A2 and obtain the audio representation R2 by calculating a weighted sum between the attention information A2 and the text representation V based on the obtained weight.

The attention module 713 may obtain audio representation R2' by concatenating the audio representation R2 and the audio representation Q2 of the second audio frame set.

The audio decoder 715 may obtain the audio feature of the second audio frame set by decoding the audio representation R2' received from the attention module 713.

The audio decoder 715, for example, may obtain the audio feature of the third audio frame set succeeding the second audio frame set as a result of a convolution operation based on the audio representation R2, the audio representation Q2, and the audio representation (e.g., at least one of the audio representation R0 or the audio representation R1 and at least one of the audio representation Q0 or the audio representation Q1) generated with respect to the audio frame set temporally preceding the four audio frames.

The vocoder 717 may synthesize speech based on at least one of the audio feature of the first audio frame set 720, the audio feature of the second audio frame set, or the audio feature of the third audio frame set.

The electronic apparatus according to an embodiment of the disclosure may repeatedly perform the feedback loop, which is used to obtain the audio features of the first audio frame set 720, the second audio frame set, and the third audio frame set, until all features of the audio frame sets corresponding to the text L are obtained.

For example, when it is determined that the attention information A generated by the attention module 713 corresponds to the last sequence among the embeddings for each character included in the text L, the electronic apparatus may determine that all the features of the audio frame sets corresponding to the input text L have been obtained and may end the repetition of the feedback loop.

Figure 8:
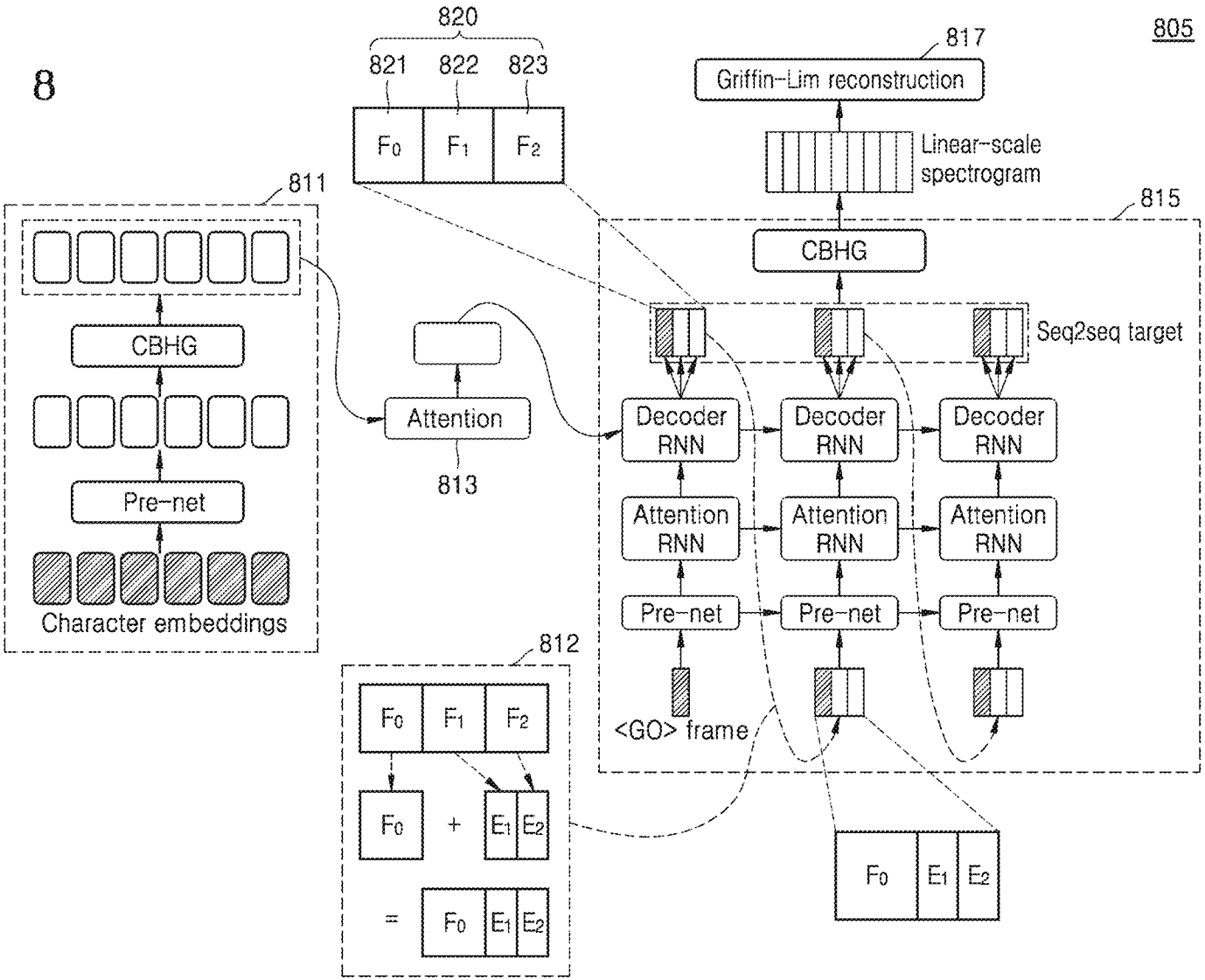
FIG. 8 is a diagram illustrating a method, performed by an electronic apparatus, of synthesizing speech using a speech synthesis model including a recurrent neural network (RNN), according to an embodiment of the disclosure.

FIG. 8 is a diagram illustrating a method, performed by an electronic apparatus, of synthesizing speech using a speech synthesis model including an RNN, according to an embodiment of the disclosure.

Referring to FIG. 8, the electronic apparatus according to an embodiment of the disclosure may synthesize speech from text using a speech synthesis model. The speech synthesis model 805 may include a text encoder 811, an attention module 813, an audio decoder 815, and a vocoder 817.

The text encoder 811 may obtain text representation by encoding the input text.

The text encoder 811 may include, for example, an embedding module that obtains embeddings for each character included in the text, a pre-net module that converts the embeddings into text representation, and a 1D convolution bank+highway network+bidirectional gated recurrent unit (GRU) (CBHG) module.

When the embeddings for each character included in the text are obtained through the embedding module of the text encoder 811, the obtained embeddings may be converted into text representation in the pre-net module and the CBHG module.

The attention module 813 may obtain attention information for identifying a portion of the text representation requiring attention, based on the text representation received from the text encoder 811 and audio representation of a first audio frame set received from the audio decoder 815.

For example, when feedback information to be generated corresponds to the first feedback information for the start of the feedback loop, the feedback information generator 812 may generate feedback information used to obtain an audio feature of a second audio frame set by using a start audio frame (go frame) having a value of 0 as a first audio frame.

When the feedback information is generated by the feedback information generator 812, the audio decoder 815 may obtain the audio representation of the first audio frame by encoding the audio feature of the first audio frame using the pre-net module and the attention RNN module.

When the audio representation of the first audio frame is obtained, the attention module 813 may generate attention information based on the text representation, to which the previous attention information is applied, and the audio representation of the first audio frame. The attention module 813 may obtain audio representation of a second audio frame set 820 using the text representation and the generated attention information.

The audio decoder 815 may use a decoder RNN module to obtain an audio feature of the second audio frame set 820 from the audio representation of the first audio frame and the audio representation of the second audio frame set 820. The vocoder 817 may synthesize speech based on at least one of the audio feature of the first audio frame set or the audio feature of the second audio frame set 820.

When the audio feature of the second audio frame set 820 is obtained, the audio decoder 815 may transmit the obtained audio feature of the second audio frame set 820 to the feedback information generator 812.

The second audio frame set 820 may include first to third audio frames 821 to 823. The feedback information according to an embodiment of the disclosure may be generated by combining information $F^0$ about the audio feature of the first audio frame 821 with pieces of compression information $E_1$ and $E_2$ about the second and third audio frames 822 and 823. FIG. 8 illustrates that the second audio frame set 820 includes a total of three audio frames 821, 822, and 823, but this is only an example for convenience of explanation. The number of audio frames is not limited thereto. For example, the second audio frame 820 may include one, two, or four or more audio frames.

The feedback information generator 812 may transmit the generated feedback information to the audio decoder 815.

The audio decoder 815 having received the feedback information may use the pre-net module and the attention RNN module to obtain audio representation of the audio frame set 820 by encoding the audio feature of the second audio frame set 820, based on the received feedback information and the previous feedback information.

When the audio representation of the second audio frame set 820 is obtained, the attention module 813 may generate attention information based on the text representation, to which the previous attention information is applied, and the audio representation of the second audio frame set 820. The attention module 813 may obtain audio representation of a third audio frame set using the text representation and the generated attention information.

The audio decoder 815 may use the decoder RNN module to obtain an audio feature of a third audio frame from the audio representation of the second audio frame set 820 and the audio representation of the third audio frame set.

The vocoder 817 may synthesize speech based on at least one of the audio feature of the first audio frame set, the audio feature of the second audio frame set 820, or the audio feature of the third audio frame set.

The electronic apparatus according to an embodiment of the disclosure may repeatedly perform the feedback loop, which is used to obtain the audio features of the first to third audio frame sets, until all features of the audio frame sets corresponding to the text are obtained.

For example, when the attention information generated by the attention module 813 corresponds to the last sequence among the embeddings for each character included in the text, the electronic apparatus may determine that all the features of the audio frame sets corresponding to the input text have been obtained and may end the repetition of the feedback loop.

However, the disclosure is not limited thereto, and the electronic apparatus may end the repetition of the feedback loop using a separate neural network model that has been previously trained regarding the repetition time of the feedback loop. In an embodiment of the disclosure, the electronic apparatus may end the repetition of the feedback loop using a separate neural network model that has been trained to perform stop token prediction.

Figure 9:
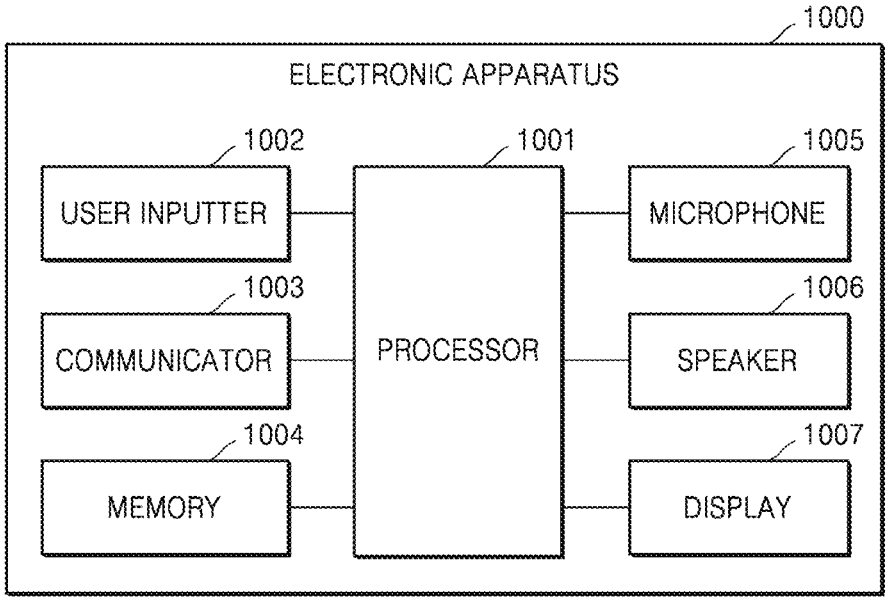
FIG. 9 is a block diagram illustrating a configuration of an electronic apparatus according to an embodiment of the disclosure.

FIG. 9 is a block diagram illustrating a configuration of an electronic apparatus 1000 according to an embodiment of the disclosure.

Referring to FIG. 9, the electronic apparatus 1000 according to an embodiment of the disclosure may include a processor 1001, a user inputter 1002, a communicator 1003, a memory 1004, a microphone 1005, a speaker 1006, and a display 1007.

The user inputter 1002 may receive text to be used for speech synthesis.

The user inputter 1002 may be a user interface, for example, a key pad, a dome switch, a touch pad (a capacitive-type touch pad, a resistive-type touch pad, an infrared beam-type touch pad, a surface acoustic wave-type touch pad, an integral strain gauge-type touch pad, a piezo effecttype touch pad, or the like), a jog wheel, and a jog switch, but the user inputter 1002 is not limited thereto.

The communicator 1003 may include one or more communication modules for communication with a server 2000. For example, the communicator 1003 may include at least one of a short-range wireless communicator or a mobile communicator.

The short-range wireless communicator may include a Bluetooth communicator, a Bluetooth Low Energy (BLE) communicator, a near field communicator, a wireless local access network (WLAN) (Wi-Fi) communicator, a Zigbee communicator, an infrared data association (IrDA) communicator, a Wi-Fi Direct (WFD) communicator, an ultra wideband (UWB) communicator, or an Ant+ communicator, but is not limited thereto.

The mobile communicator may transmit and receive a wireless signal with at least one of a base station, an external terminal, or a server on a mobile communication network. Examples of the wireless signal may include various formats of data to support transmission and reception of a voice call signal, a video call signal, or a text or multimedia message.

The memory 1004 may store a speech synthesis model used to synthesize speech from text.

The speech synthesis model stored in the memory 1004 may include a plurality of software modules for performing functions of the electronic apparatus 1000. The speech synthesis model stored in the memory 1004 may include, for example, at least one of a pre-processor, a text encoder, an attention module, an audio encoder, an audio decoder, a feedback information generator, an audio decoder, a vocoder, or an audio feature extractor.

The memory 1004 may store, for example, a program for controlling the operation of the electronic apparatus 1000. The memory 1004 may include at least one instruction for controlling the operation of the electronic apparatus 1000.

The memory 1004 may store, for example, information about input text and synthesized speech.

The memory 1004 may include at least one storage medium selected from among flash memory, hard disk, multimedia card micro type memory, card type memory (e.g., SD or XD memory), random access memory (RAM), static random access memory (SRAM), read-only memory (ROM), electrically erasable programmable read-only memory (EEPROM), programmable read-only memory (PROM), magnetic memory, magnetic disk, and optical disk.

The microphone 1005 may receive a user's speech. When the user utters speech, the speech input through the microphone 1005 may be converted into, for example, an audio signal used for learning the speech synthesis model stored in the memory 1004.

The speaker 1006 may output the speech synthesized from text as sound.

The speaker 1006 may output signals related to the function performed by the electronic apparatus 1000 (e.g., a call signal reception sound, a message reception sound, a notification sound, etc.) as sound.

The display 1007 may display and output information processed by the electronic apparatus 1000.

The display 1007 may display, for example, an interface for displaying the text used for speech synthesis and the speech synthesis result.

The display 1007 may display, for example, an interface for controlling the electronic apparatus 1000, an interface for displaying the state of the electronic apparatus 1000, and the like.

The processor 1001 may control overall operations of the electronic apparatus 1000. For example, the processor 1001 may execute programs stored in the memory 1004 to control overall operations of the user inputter 1002, the communicator 1003, the memory 1004, the microphone 1005, the speaker 1006, and the display 1007.

The processor 1001 may start a speech synthesis process by activating the speech synthesis model stored in the memory 1004 when the text is input.

The processor 1001 may obtain text representation by encoding the text through the text encoder of the speech synthesis model.

The processor 1001 may use the feedback information generator of the speech synthesis model to generate feedback information used to obtain an audio feature of a second audio frame set from an audio feature of a first audio frame set among audio frames generated from text representation. The second audio frame set may be, for example, an audio frame set including frames succeeding the first audio frame set.

The feedback information may include, for example, information about the audio feature of a subset of at least one audio frame included in the first audio frame set and compression information about a subset of at least one audio frame included in the first audio frame set.

The processor 1001, for example, may use the feedback information generator of the speech synthesis model to obtain information about the audio feature of at least one audio frame included in the first audio frame set and compression information about at least one audio frame included in the first audio frame set and generate the feedback information by combining the obtained information about the audio feature of the at least one audio frame with the obtained compression information about the at least one audio frame.

The processor 1001 may generate audio representation of the second audio frame set based on the text representation and the feedback information.

The processor 1001, for example, may use the attention module of the speech synthesis model to obtain attention information for identifying a portion of the text representation requiring attention, based on the text representation and the audio representation of the first audio frame set.

The processor 1001, for example, may use the attention module of the speech synthesis model to identify and extract a portion of the text representation requiring attention, based on the attention information, and obtain audio representation of the second audio frame set by combining a result of the extracting with the audio representation of the first audio frame set.

The processor 1001, for example, may use the audio decoder of the speech synthesis model to obtain the audio feature of the second audio frame set by decoding the audio representation of the second audio frame set.

The processor 1001, for example, may use the vocoder of the speech synthesis model to synthesize speech based on at least one of the audio feature of the first audio frame set or the audio feature of the second audio frame set.

The processor 1001 according to an embodiment of the disclosure may perform, for example, artificial intelligence operations and computations. The processor 1001 may be, for example, one of a central processing unit (CPU), a graphics processing unit (GPU), a neural processing unit (NPU), a field programmable gate array (FPGA), and an application specific integrated circuit (ASIC), but is not limited thereto.

Figure 10:
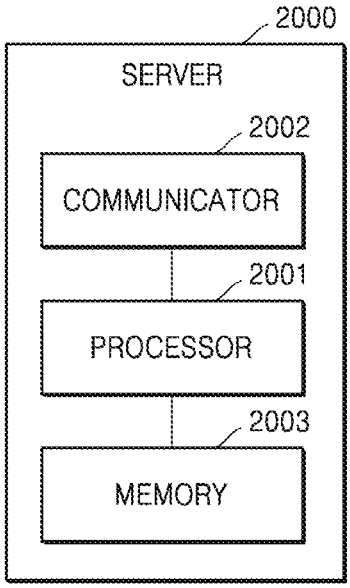
FIG. 10 is a block diagram illustrating a configuration of a server according to an embodiment of the disclosure.

FIG. 10 is a block diagram illustrating a configuration of a server 2000 according to an embodiment of the disclosure.

The speech synthesis method according to an embodiment of the disclosure may be performed by the electronic apparatus 1000 and/or the server 2000 connected to the electronic apparatus 1000 through wired or wireless communication.

Referring to FIG. 10, the server 2000 according to an embodiment of the disclosure may include a processor 2001, a communicator 2002, and a memory 2003.

The communicator 2002 may include one or more communication modules for communication with the electronic apparatus 1000. For example, the communicator 2002 may include at least one of a short-range wireless communicator or a mobile communicator.

The short-range wireless communicator may include a Bluetooth communicator, a BLE communicator, a near field communicator, a WLAN (Wi-Fi) communicator, a Zigbee communicator, an IrDA communicator, a WFD communicator, a UWB communicator, or an Ant+ communicator, but is not limited thereto.

The mobile communicator may transmit and receive a wireless signal with at least one of a base station, an external terminal, or a server on a mobile communication network. Examples of the wireless signal may include various formats of data to support transmission and reception of a voice call signal, a video call signal, or a text or multimedia message.

The memory 2003 may store a speech synthesis model used to synthesize speech from text.

The speech synthesis model stored in the memory 2003 may include a plurality of modules classified according to functions. The speech synthesis model stored in the memory 2003 may include, for example, at least one of a preprocessor, a text encoder, an attention module, an audio encoder, an audio decoder, a feedback information generator, an audio decoder, a vocoder, or an audio feature extractor.

The memory 2003 may store a program for controlling the operation of the server 2000. The memory 2003 may include at least one instruction for controlling the operation of the server 2000.

The memory 2003 may store, for example, information about input text and synthesized speech.

The memory 2003 may include at least one storage medium selected from among flash memory, hard disk, multimedia card micro type memory, card type memory (e.g., SD or XD memory), RAM, SRAM, ROM, EEPROM, PROM, magnetic memory, magnetic disk, and optical disk.

The processor 2001 may control overall operations of the server 2000. For example, the processor 2001 may execute programs stored in the memory 2003 to control overall operations of the communicator 2002 and the memory 2003.

The processor 2001 may receive text for speech synthesis from the electronic apparatus 1000 through the communicator 2002.

The processor 2001 may start a speech synthesis process by activating the speech synthesis model stored in the memory 2003 when the text is received.

The processor 2001 may obtain text representation by encoding the text through the text encoder of the speech synthesis model.

The processor 2001 may use the feedback information generator of the speech synthesis model to generate feedback information used to obtain an audio feature of a second audio frame set from an audio feature of a first audio frame set among audio frames generated from text representation. The second audio frame set may be, for example, an audio frame set including frames succeeding the first audio frame set.

The feedback information may include, for example, information about the audio feature of a subset of at least one audio frame included in the first audio frame set and compression information about at least one audio frame of a subset included in the first audio frame set.

The processor 2001, for example, may use the feedback information generator of the speech synthesis model to obtain information about the audio feature of at least one audio frame included in the first audio frame set and compression information about at least one audio frame included in the first audio frame set and generate the feedback information by combining the obtained information about the audio feature of the at least one audio frame with the obtained compression information about the at least one audio frame.

The processor 2001 may generate audio representation of the second audio frame set based on the text representation and the feedback information.

The processor 2001, for example, may use the attention module of the speech synthesis model to obtain attention information for identifying a portion of the text representation requiring attention, based on the text representation and the audio representation of the first audio frame set.

The processor 2001, for example, may use the attention module of the speech synthesis model to identify and extract a portion of the text representation requiring attention, based on the attention information, and obtain audio representation of the second audio frame set by combining a result of the extracting with the audio representation of the first audio frame set.

The processor 2001, for example, may use the audio decoder of the speech synthesis model to obtain the audio feature of the second audio frame set by decoding the audio representation of the second audio frame set.

The processor 2001, for example, may use the vocoder of the speech synthesis model to synthesize speech based on at least one of the audio feature of the first audio frame set or the audio feature of the second audio frame set.

The processor 2001 according to an embodiment of the disclosure may perform, for example, artificial intelligence operations. The processor 2001 may be, for example, one of a CPU, a GPU, an NPU, an FPGA, and an ASIC, but is not limited thereto.

An embodiment of the disclosure may be implemented in the form of a recording medium including computer-executable instructions, such as a computer-executable program module. A non-transitory computer-readable medium may be any available medium that is accessible by a computer and may include any volatile and non-volatile media and any removable and non-removable media. Also, the non-transitory computer-readable recording medium may include any computer storage medium. The computer storage medium may include any volatile and non-volatile media and any removable and non-removable media implemented by any method or technology for storing information such as computer-readable instructions, data structures, program modules, or other data.

Also, the term "module" or "-or/-er" used herein may be a hardware component such as a processor or a circuit, and/or a software component executed by a hardware component such as a processor.

According to the disclosure, the speech synthesis method and apparatus capable of synthesizing speech corresponding to input text by obtaining the current audio frame using feedback information including information about energy of the previous audio frame may be provided.

Throughout the disclosure, the expression "at least one of a, b or c" indicates only a, only b, only c, both a and b, both a and c, both b and c, all of a, b, and c, or variations thereof.

The foregoing description of the disclosure is for illustration and those of ordinary skill in the art will appreciate that modifications may be easily made to other specific forms without changing the technical spirit or essential features of the disclosure. Therefore, it will be understood that the embodiments of the disclosure described above are illustrative in all aspects and not restrictive. For example, each element described as a single type may be implemented in a distributed manner. Similarly, elements described as distributed may be implemented in a combined form.

The scope of the disclosure is indicated by the claims rather than the above detailed description, and it should be construed that all changes or modifications derived from the meaning and scope of the claims and equivalent concepts thereof fall within the scope of the disclosure.

What is claimed is:

1. A method, performed by an electronic apparatus, of synthesizing speech from text, the method comprising:

obtaining text input to the electronic apparatus;

obtaining a text representation of the text by encoding the text using a text encoder of the electronic apparatus;

obtaining a first audio representation of a first audio frame set of the text from an audio encoder of the electronic apparatus, based on the text representation;

obtaining a first audio feature of the first audio frame set by decoding the first audio representation of the first audio frame set;

obtaining a second audio representation of a second audio frame set of the text based on the text representation and the first audio representation of the first audio frame set;

obtaining a second audio feature of the second audio frame set by decoding the second audio representation of the second audio frame set;

generating feedback information by combining audio feature information of at least one audio frame of the second audio frame set with compression information about the at least one audio frame of the second audio frame set; and synthesizing speech corresponding to the text based on the first audio feature of the first audio frame set and the second audio feature of the second audio frame set.

2. The method of claim 1, wherein the second audio frame set includes at least one audio frame succeeding a last audio frame of the first audio frame set.

3. The method of claim 1, wherein the generating of the feedback information comprises:

obtaining the audio feature information of the at least one audio frame of the second audio frame set; and obtaining the compression information about the at least one audio frame of the second audio frame set.

4. The method of claim 1, wherein the feedback information is used to obtain an audio feature of a third audio frame set succeeding the second audio frame set.

5. The method of claim 1, wherein the compression information includes at least one of a first magnitude of an amplitude value of an audio signal corresponding to the at least one audio frame, a second magnitude of a root means square (RMS) of the amplitude value of the audio signal, or a third magnitude of a peak value of the audio signal.

6. The method of claim 1, wherein the obtaining of the second audio representation comprises:

obtaining attention information for identifying a portion of the text representation requiring attention, based on at least part of the text representation and the first audio representation of the first audio frame set; and obtaining the second audio representation of the second audio frame set based on the text representation and the attention information.

7. An electronic apparatus for synthesizing speech from text, the electronic apparatus comprising:

a memory storing instructions; and at least one processor communicatively coupled to the memory, wherein the at least one processor is configured to execute the instructions to:

obtain text input to the electronic apparatus;

obtain a text representation of the text by encoding the text;

obtain a first audio representation of a first audio frame set of the text based on the text representation;

obtain a first audio feature of the first audio frame set by decoding the first audio representation of the first audio frame set;

obtain a second audio representation of a second audio frame set of the text based on the text representation and the first audio representation of the first audio frame set;

obtain a second audio feature of the second audio frame set by decoding the second audio representation of the second audio frame set;

generate feedback information by combining audio feature information of at least one audio frame of the second audio frame set with compression information about the at least one audio frame of the second audio frame set; and synthesize speech corresponding to the text based on the first audio feature of the first audio frame set and the second audio feature of the second audio frame set.

8. The electronic apparatus of claim 7, wherein the second audio frame set includes at least one audio frame succeeding a last audio frame of the first audio frame set.

9. The electronic apparatus of claim 7, wherein the at least one processor is further configured to generate the feedback information based on the second audio feature of the second audio frame set by obtaining the audio feature information of the at least one audio frame of the second audio frame set, and obtaining the compression information about the at least one audio frame of the second audio frame set.

10. The electronic apparatus of claim 7, wherein the feedback information is used to obtain an audio feature of a third audio frame set succeeding the second audio frame set.

11. The electronic apparatus of claim 7, wherein the compression information includes at least one of a first magnitude of an amplitude value of an audio signal corresponding to the at least one audio frame, a second magnitude of a root means square (RMS) of the amplitude value of the audio signal, or a third magnitude of a peak value of the audio signal.

12. The electronic apparatus of claim 7, wherein the at least one processor is further configured to obtain the second audio representation by obtaining attention information for identifying a portion of the text representation requiring attention, based on at least part of the text representation and the first audio representation of the first audio frame set, and obtain the second audio representation of the second audio frame set based on the text representation and the attention information.

13. A non-transitory computer-readable recording medium having recorded thereon a program for executing, on an electronic apparatus, a method of synthesizing speech from text, the method comprising:

obtaining text input to the electronic apparatus;

obtaining a text representation of the text by encoding the text using a text encoder of the electronic apparatus;

obtaining a first audio representation of a first audio frame set of the text from an audio encoder of the electronic apparatus, based on the text representation;

obtaining a first audio feature of the first audio frame set by decoding the first audio representation of the first audio frame set;

obtaining a second audio representation of a second audio frame set of the text based on the text representation and the first audio representation of the first audio frame set;

obtaining a second audio feature of the second audio frame set by decoding the second audio representation of the second audio frame set;

generate feedback information by combining audio feature information of at least one audio frame of the second audio frame set with compression information about the at least one audio frame of the second audio frame set; and synthesizing speech corresponding to the text based on the first audio feature of the first audio frame set and the second audio feature of the second audio frame set.

14. A method, performed by an electronic apparatus, of synthesizing speech from text, the method comprising:

obtaining a first audio feature of a first audio frame set by decoding a text representation of a text input;

obtaining a second audio feature of a second audio frame set by decoding the text representation and a combination of a third audio feature of at least one audio frame of the first audio frame set and compression information of the at least one audio frame of the first audio frame set; and synthesizing speech corresponding to the text input based on the first audio feature of the first audio frame set and the second audio feature of the second audio frame set.

15. The method of claim 14, wherein the second audio frame set includes at least one audio frame succeeding a last audio frame of the first audio frame set.

16. The method of claim 14, wherein the compression information includes at least one of a first magnitude of an amplitude value of an audio signal corresponding to the at least one audio frame of the first audio frame set, a second magnitude of a root means square (RMS) of the amplitude value of the audio signal, or a third magnitude of a peak value of the audio signal.

17. The method of claim 14, wherein the obtaining of the second audio feature comprises:

obtaining attention information for identifying a portion of the text representation requiring attention, based on at least part of the text representation and a first audio representation of the first audio frame set; and obtaining a second audio representation of the second audio frame set based on the text representation and the attention information.

* * * * *